US006868631B2

(12) United States Patent
Chen

(10) Patent No.: US 6,868,631 B2
(45) Date of Patent: Mar. 22, 2005

(54) FRONT SIGHT NIGHT VISION DEVICE

(76) Inventor: Guan-Ming Chen, No. 12-4, Nan Ho Rd., Tainan (TW)

( * ) Notice: Subject to any disclaimer, the term of this patent is extended or adjusted under 35 U.S.C. 154(b) by 22 days.

(21) Appl. No.: 10/401,984

(22) Filed: Mar. 31, 2003

(65) Prior Publication Data

US 2004/0200118 A1 Oct. 14, 2004

(51) Int. Cl.[7] ..... F41C 3/14

(52) U.S. Cl. ..... 42/132; 42/117; 42/146; 362/188

(58) Field of Search ..... 42/132, 117, 123, 42/146; 362/188, 197, 198, 199, 203

(56) References Cited

U.S. PATENT DOCUMENTS 807,993 A * 12/1905 Bassell et al. ..... 42/132
1,017,991 A * 2/1912 Olson ..... 42/132
1,084,905 A * 1/1914 Schwarz ..... 42/132
1,599,499 A * 9/1926 ST John ..... 362/197
2,529,057 A * 11/1950 Teffault ..... 42/132
2,697,128 A * 12/1954 Moore ..... 429/99
3,288,988 A * 11/1966 Boggs ..... 362/197
3,826,910 A * 7/1974 Davis ..... 362/99
3,833,799 A * 9/1974 Audet ..... 42/132
4,195,414 A * 4/1980 Robinson ..... 33/265

* cited by examiner

*Primary Examiner*—Michael J. Carone
*Assistant Examiner*—M. Thomson
(74) *Attorney, Agent, or Firm*—Rosenberg, Klein & Lee

(57) ABSTRACT

A night vision device to mark the location of a front sight on a rifle or a modern bow includes a casing, a power source and a light emission device adapted to the front sight. Wherein, the casing contains the power source connected to the light emission device, and a light conductor is further provided to the front of the light emission device so to mark the location of the front sight to aim at a selected target by the light emitted from the light emission device during night hours or where poor visual contact presents.

6 Claims, 9 Drawing Sheets

FRONT SIGHT NIGHT VISION DEVICE

BACKGROUND OF THE INVENTION (a) Field of the Invention

The present invention relates to a front sight night vision device, and more particularly, to one that is adapted to a rifle or a bow and that emits light to mark the location of the front sight during night hours or where visual contact is poor.

(b) Description of the Prior Art

Whereas a front sight is required to aim at the target in shooting a bow or a rifle, the front sight may be easily seen during the daytime or where well-lighted. However, during night hours or where only poor visual contact is possible, the front sight may not be easily seen, thus affecting the percentage of proper targeting. Therefore, it is necessary to design a night vision device to mark the location of the front sight.

SUMMARY OF THE INVENTION

The primary purpose of the present invention is to provide a night vision device to mark the location of the front sight during night hours. To achieve this purpose, the present invention is essentially comprised of a casing, a power source, and a light emission device adapted to the front sight; wherein, the casing contains a tube and a switch with the switch controlling the power source, the power being conducted through the light emission device so as to mark the location of the front sight during night hours or where visual contact is poor.

Another purpose of the present invention is to provide a night vision device to mark the location of the front sight during night hours; wherein, a light conductor is further provided at the front end of the light emission device to direct the light to the front sight.

Another purpose of the present invention is to provide a night vision device to mark the location of the front sight; wherein, the casing contains a tube and a switch, and the switch includes a first switch and a second switch. The second switch includes an elastic member and a sleeve. Both ends of the tube are externally threaded, and both of the first and the second switches, respectively, in relation to the tube, are also threaded so to engage both ends of the tube. A hole is drilled through the mid-section of the tube. One end of the elastic member is fixed in the second switch and the other end of the elastic member is fixed to the sleeve. The power source is provided with a first electrode and a second electrode. The light emission device is provided with a first electrode pin and a second electrode pin so that the light emission device is inserted through the hole in the middle of the tube of the casing with the first electrode pin and the second electrode pin of the light emission device contained within the tube. The power source is received in the tube of the casing and is threaded to one end of the tube with the first switch. The second electrode of the power source contacts the first electrode pin of the light emission device, and the second electrode of the power source contacts the first switch. The second switch is threaded to another end of the tube. By tightening up the second switch, the elastic member and the sleeve are held against the second electrode pin of the light emission device. The first switch is released from contacting the first electrode of the power source by loosening up the first switch; or by loosening up the second switch. Both the elastic member and the sleeve are released from contacting the second electrode pin of the light emission device by loosening up the second switch.

Another purpose of the present invention is to provide a night vision device to mark the location of the front sight; wherein a retainer is provided in the first switch, an insulation elastic washer is inserted at the bottom of the retainer so that once the first switch is tightened up, the elastic washer is slightly compressed for the retainer to hold against the power source.

Another purpose yet of the present invention is to provide a night vision device to mark the location of the front sight; wherein the light conductor is an optical fiber.

Another purpose of the present invention is to provide a night vision device to mark the location of the front sight; wherein the light conductor is an optical fiber wrapped in a protection tube.

Another purpose of the present invention is to provide a night vision device to mark the location of the front sight; wherein; the protection tube wrapping up the light conductor is comprised of a flexible section connected with a rigid section.

DETAILED DESCRIPTION OF THE PREFERRED EMBODIMENTS

Figure 1:
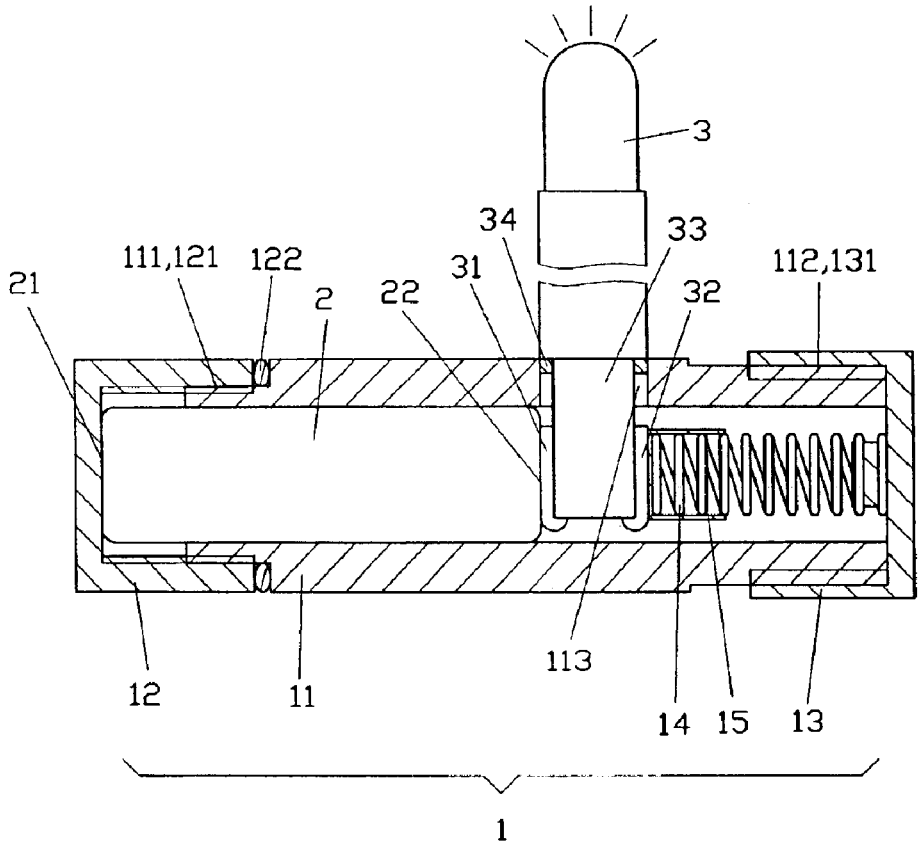
FIG. 1 is a cross-sectional view of an assembly of a first preferred embodiment of the present invention.
Figure 4:
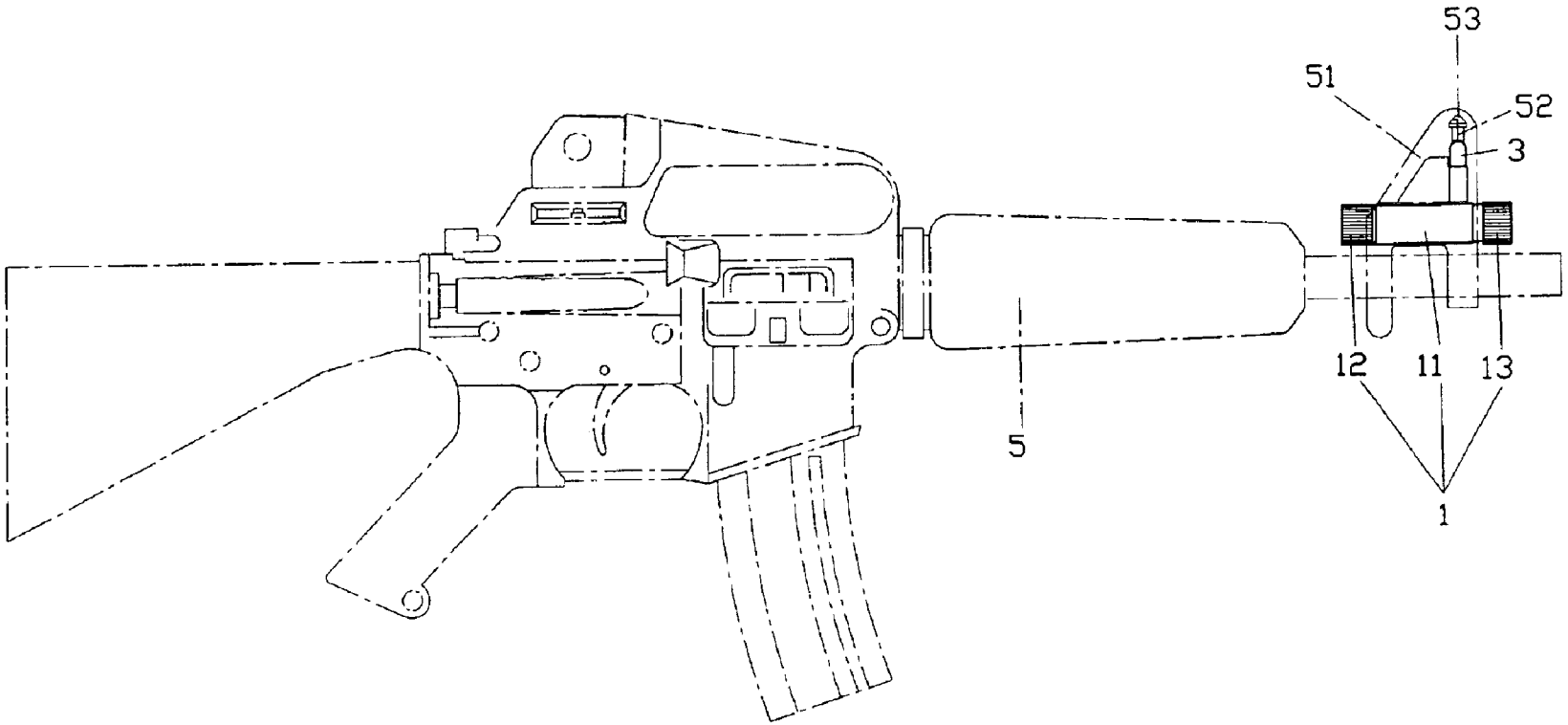
FIG. 4 is a view showing that the first preferred embodiment of the present invention is adapted to an automatic rifle.

Referring to FIG. 1, a first preferred embodiment of the present invention is comprised of a casing (1), a power source (2), and a light emission device (3) adapted to a front sight housing (51) (as illustrated in FIG. 4). The light emission device (3) emits the light to mark the location of a front sight in the front sight housing (51).

The casing (1) includes a hollow tube (11) and a switch set. The switch set includes a first switch (12) and a second switch (13). The second switch (13) contains an elastic member (14) and a sleeve (15). The tube (11) has both its ends respectively provided with external threads (111) and (112). Threads (121) and (131) are respectively provided on the first switch (12) and the second switch (13) for both the first switch (12) and the second switch (13) to respectively engage both ends of the tube (11). A washer (122) is adapted to the first switch (12) for waterproofing, once the present invention is assembled. A hole (113) is drilled through the mid-section of the tube (11). One end of the elastic member (14) is fixed to the second switch in the tube (11), and the other end of the elastic member (14) is fixed to the sleeve (15).

The power source (2) contains a first electrode (21) and a second electrode (22).

The light emission device (3) includes a first electrode pin (31) and a second electrode pin (32). An insulation block (33) is inserted into the gap between the first electrode pin (31) and the second electrode pin (32). Another washer (34) is adapted to the insulation block (33) for waterproofing purposes, once the present invention is assembled.

Upon assembly, the light emission device (3) is inserted through the hole (113) in the mid-section of the tube (11) of the casing (1) to be contained together with the first electrode pin (31) and the second electrode pin (32) within the tube (11). The power source (2) is contained inside the tube (11) of the casing (1) with the thread (121) of the first switch (12) engaging the thread (111) at one end of the tube (111) so that the second electrode (22) of the power source (2) contacts the first electrode pin (31) of the light emission device (3), and the first electrode (21) of the power source (2) contacts the first switch (12). The second switch (13) engages the thread (112) on the other end of the tube (11) with the thread (131). The sleeve (15), at one end of the elastic member (14), is held against the second electrode pin (32) of the light emission device (3) by tightening up the second switch (13). The casing (1) is conducts power from the power source (2) and the light emission device (3) for the light emission device (3) to emit light due to the fact that the tube (11), the first switch (12), the second switch (13) of the casing (1), and the elastic member (14) and the sleeve (15) are all conductors.

Figure 2:
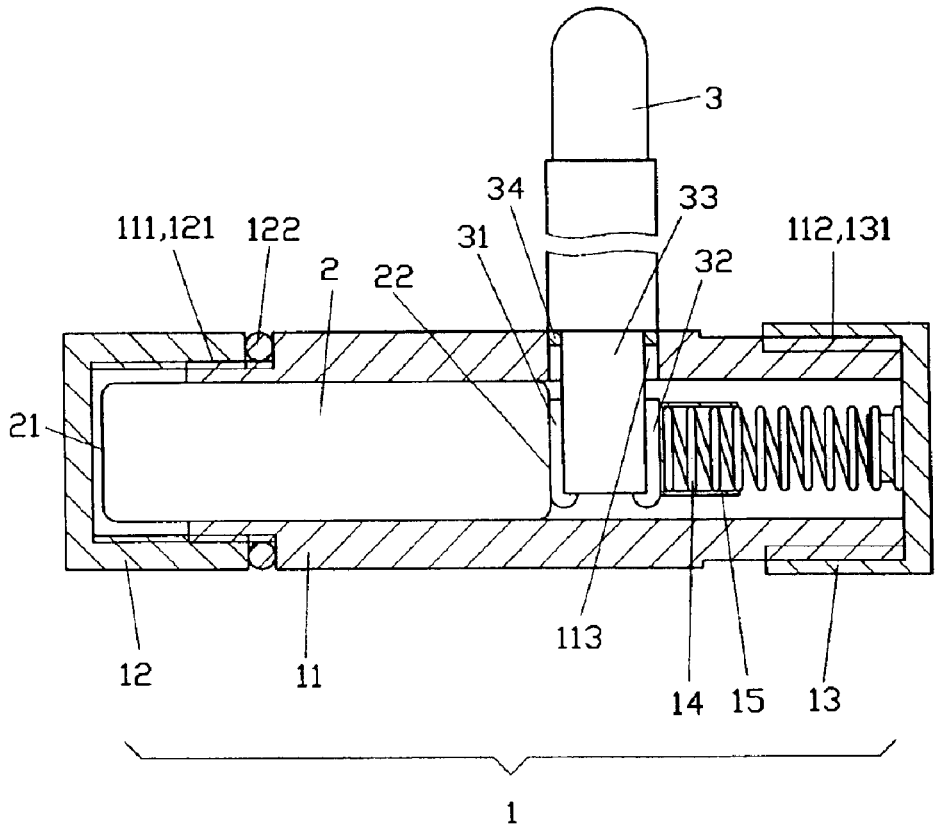
FIG. 2 is a view showing the operation of a first switch of the first preferred embodiment of the present invention.

As illustrated in FIG. 2, the light emission device (3) is prevented from emitting light by loosening up the first switch (12) for the first switch (12) to no longer contact the first electrode (21) of the power source (2), thus forming an off circuit between the power source (2) and the light emission device (3).

Figure 3:
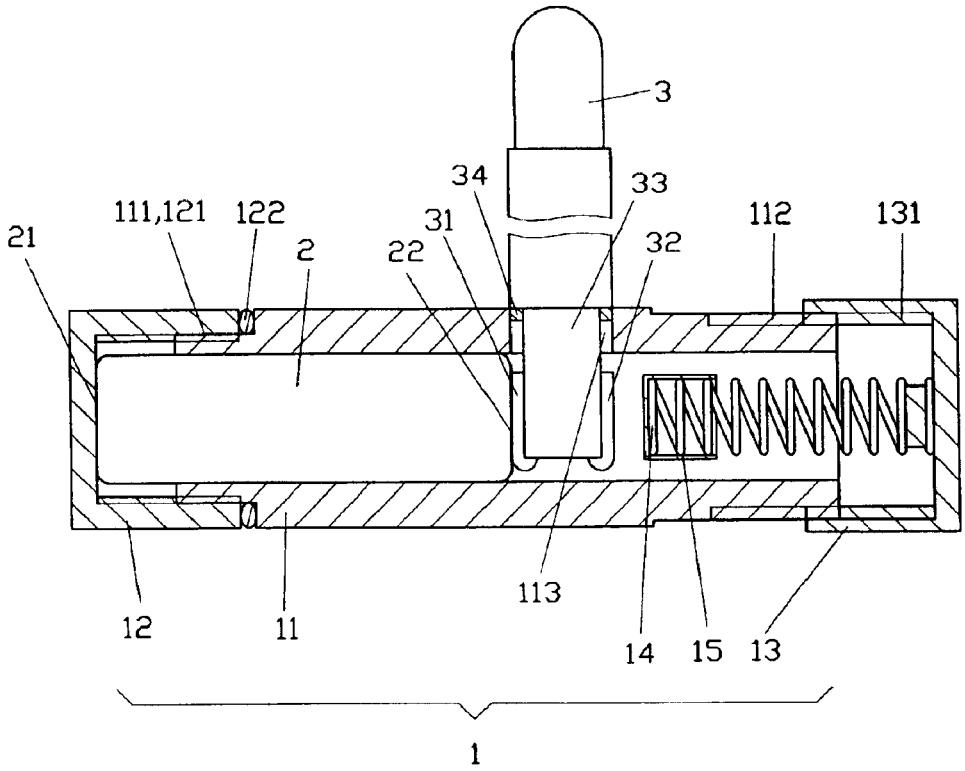
FIG. 3 is a view showing the operation of a second switch of the first preferred embodiment of the present invention.

Now referring to FIG. 3, the light emission device (3) is prevented from emitting light by loosening up the second switch (13) for both of the elastic member (14) and the sleeve (15) to no longer contact the second electrode pin (32) of the light emission device (3) to form an off circuit between the power source (2) and the light emission device (3).

FIG. 4 is a schematic view showing that the first preferred embodiment of the present invention as applied to an automatic rifle (5). Wherein, the front sight housing (51) of the automatic rifle (5) is comparatively larger in size, a drill-hole is formed in the front sight housing (51) to directly fix the tube (11) of the casing (1) to the front sight housing (51) to expose both of the first switch (12) and the second switch (13) out of the front sight housing (51) in order to facilitate the operation of the first preferred embodiment of the present invention. Furthermore, a hole (52) having a smaller diameter is drilled through the front sight housing (51) to be directly connected through the location of a front sight (53) while the light emission device (3) is located in the front sight housing (51) below the hole (52) for the light emitted from the light emission device (3) to be transmitted through the hole (52) in the front sight housing (51), where the front sight (53) is located. Thus, this allows a user of the automatic rifle (5) to identify the location of the front sight (53) when the preferred embodiment is properly employed.

Figure 5:
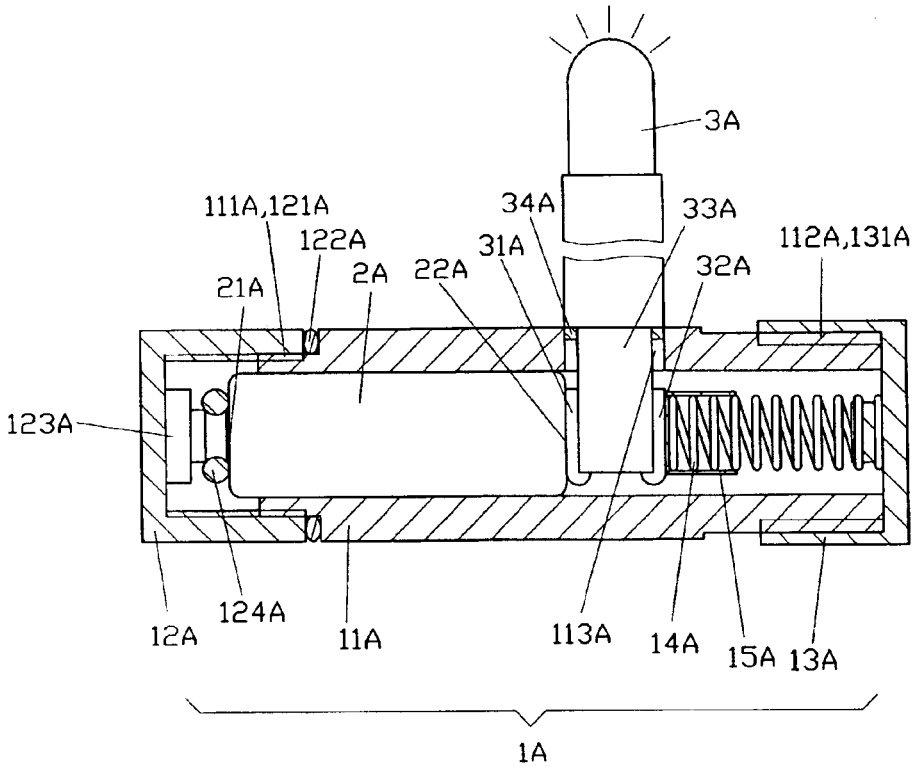
FIG. 5 is a cross-sectional view of an assembly of a second preferred embodiment of the present invention.

A second preferred embodiment of the present invention is illustrated in FIG. 5 and comprises a casing (1A), a power source (2A), and a light emission device (3A). The casing (1A) includes a hollow tube (11A), a first switch (12A), a second switch (13A), and an elastic member (14A). Both ends of the tube (11A) are respectively provided with external threads (111A) and (112A). Threads (121A) and (131A) are respectively provided on the first switch (12A) and the second switch (13A) to respectively engage both ends of the tube (11A). A washer (122A) is adapted to the first switch (12A) for waterproofing purposes once the second preferred embodiment of the present invention is assembled. A hole (113A) is drilled in the middle of the tube (11A) and communicates with the interior of the tube (11A). One end of the elastic member (14A) is fixed in the second switch (13A) while the other end of the elastic member (14A) is fixed to the sleeve (15A). The power source (2A) includes a first electrode (21A) and a second electrode (22A). The light emission device (3A) contains a first electrode pin (31A) and a second electrode ping (32A). An insulation block (33A) is provided between the first electrode pin (32A) and the second electrode pin (33A) and another washer (34A) is adapted to the light emission device (3A) for waterproofing purposes once the second preferred embodiment of the present invention is assembled. The second preferred embodiment differs from the first preferred embodiment of the present invention in that a retainer (123A) is provided in the first switch (12A) of the second preferred embodiment and also an insulation elastic washer (124A); i.e., an O-ring, as illustrated, is inserted at the top of the retainer (123A) so that upon tightening the first switch (12A), the elastic washer (124A) is slightly compressed for the retainer (123A) to be held against the first electrode (21A) of the power source (2A), thus conducting both of the power source (2A) and the light emission device (3A) for the light emission device (3A) to emit light. Further, the light emission device (3A) is prevented from emitting the light upon loosening up of the first switch (12A).

Figure 6:
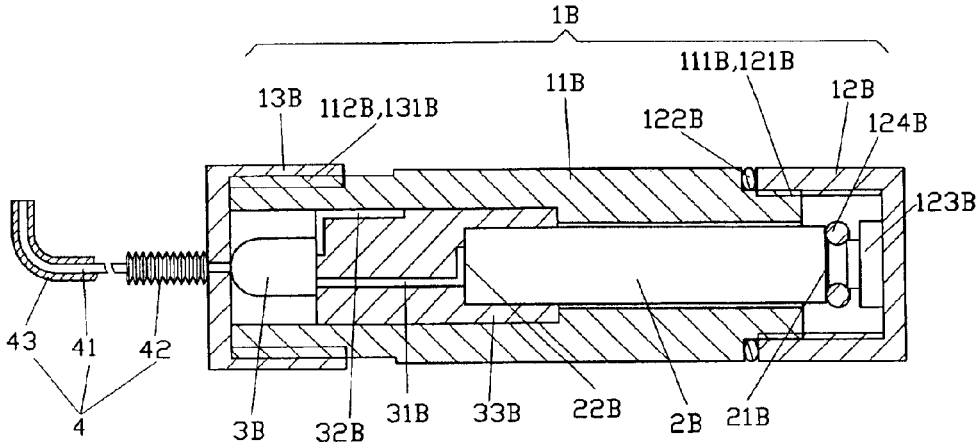
FIG. 6 is a cross-sectional view of an assembly of a third preferred embodiment of the present invention.

As illustrated in FIG. 6, a third preferred embodiment of the present invention includes a casing (1B), a power source (2B), a light emission device (3B) and a light conductor (4).

The casing (1B includes a tube (1B), a first switch (12B), and a second switch (13B). Both ends of the tube (11B) are respectively provided with external threads (111B) and (112B) and matching threads (121B) and (131B) respectively engage both ends of the tube (11B). A washer (122B) is adapted to the first switch (12B) for waterproofing purposes once the third preferred embodiment of the present invention is assembled. A retainer (123B) is provided in the first switch (12B) and also an insulation elastic washer (124B); i.e., an O-ring, as illustrated, is inserted at the top of the retainer (123B). When tightening the first switch (12B), the elastic washer (124B) is slightly compressed for the retainer (123B) to be held against a first electrode (21B) of the power source (2B), thus to conduct both of the power source (2B) and the light emission device (3B) for the light emission device (3A) to emit light. Further, the light emission device (3B) is prevented from emitting light upon loosening of the first switch (12B). The second switch (13B) in the third preferred embodiment is not operated in normal use as it is only loosened when replacement of the light emission device (3B) is required.

The power source (2B) includes a first electrode (21B) and a second electrode (22B).

The light emission device (3B) contains a first electrode pin (31B) and a second electrode ping (32B); an insulation block (33B) is provided between the first electrode pin (32B) and the second electrode pin (32B), both of the first electrode pin (32B) and the first electrode pin (31B) is are inserted into the insulation block (33B) while the second electrode pin (32B) rests flushed against the outer side of the insulation block (33B).

The light conductor (4) includes an optical fiber (41), a flexible protection tube (42), and a rigid protection tube (43). One end of the optical fiber (41) is inserted in and fixed to the second switch (13B), in front of the light emission device (3B). The optical fiber (41) is wrapped up with a protection tube comprised of the flexible protection tube (42) and the rigid protection tube (43). One end of the flexible protection tube (42) is fixed to the second switch (13B) to conduct the light emitted from the light emission device (3B) into the optical fiber (42). Another end of the flexible protection tube (42) is connected to one end of the rigid protection tube (3B) while the other end of the rigid protection tube (43) is provided on the front sight (53A) (as illustrated in FIG. 7).

Upon assembly, the power source (2B) is provided in the mid-sections of the tube (11B) of the casing (1B) and the light emission device (3B) is inserted into the tube (11B) with the insulation block (33B). Though the first electrode pin (31B) inserted into the insulation block (33B) does not contact the inner wall of the tube (11B), the first electrode pin (31B) contacts the second electrode (22B) of the power source (2B), and the second electrode pin (32B) of the light emission device (3B) contacts the inner wall of the tube (11B). Furthermore, the second switch (13B) engages the thread (131B) with the thread (112B) on the other end of the tube (11B) and the second electrode (22B) of the power source (2B) contacts the first electrode pin (31B) of the light emission device (3B) so that by tightening the first switch (12B), the elastic washer (124B) is slightly compressed for the retainer (123B) to contact the first electrode (21B) of the power source (2B) to conduct the power source (2B) and the light emission device (3B) for the light emission device (3B) to emit light. Further, the light emission device (3B) is prevented from emitting light by loosening up the first switch (112B).

The operation of loosening up the switch for the third preferred embodiment is similar to that of the second preferred embodiment of the present invention. By referring to the description given for FIG. 5, the description of the operation does not need to be repeated here.

Figure 7:
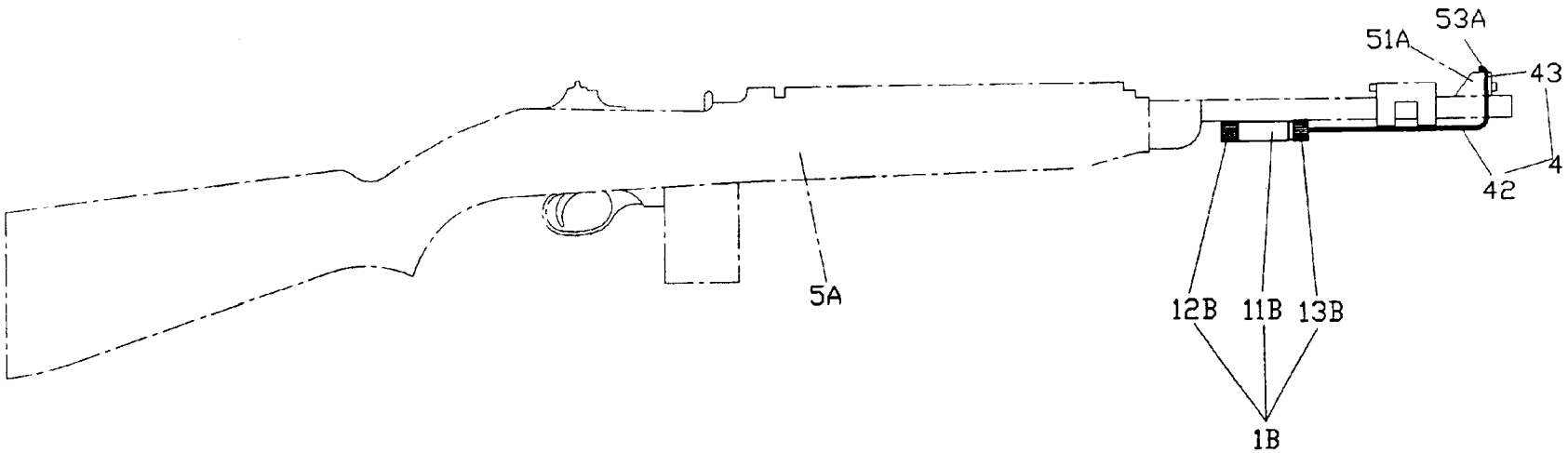
FIG. 7 is a view showing that the third preferred embodiment of the present invention is adapted to an automatic rifle.

FIG. 7 shows a schematic view of the application of the third preferred embodiment of the present invention in a rifle (5A) where a front sight housing (51A) of the rifle (5A) is too small in size to drill a hole for direct fixation of the tube (11B) of the casing (1B). Therefore, the tube (11B) of the casing (1B) is provided on a barrel or a hand guard of the rifle (5A), leaving both the first switch (12B) and the second switch (13B) exposed to facilitate operation. Although the light conductor (4) is fixed to the tube (11B), the flexible protection tube (42) and the rigid protection tube (43) are extended to the other end of the optical fiber (41) (not illustrated as it is contained in both of the flexible protection tube (42) and the rigid protection tube (43)) at the location of the front sight (51A).

Figure 8:
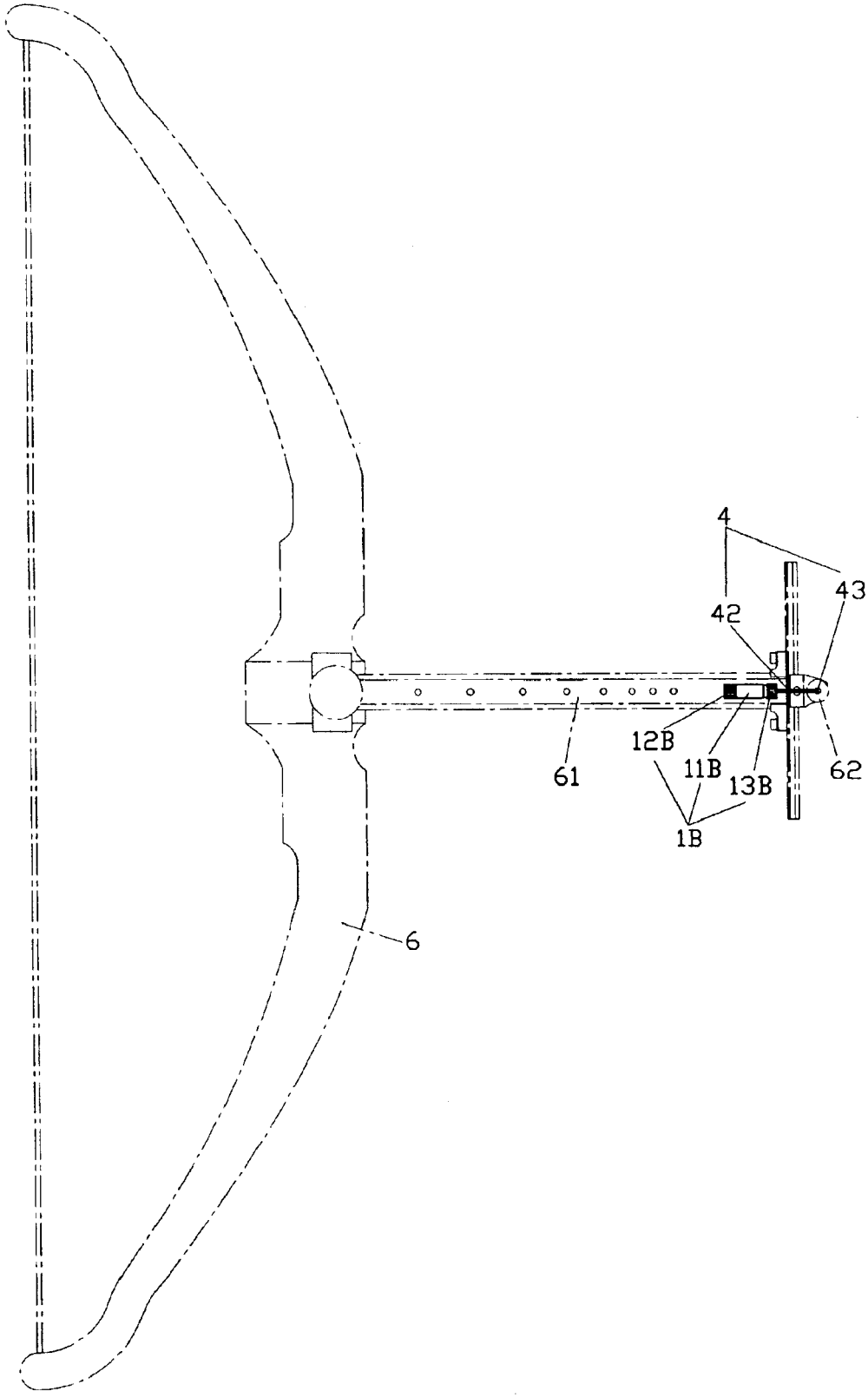
FIG. 8 is a view showing that the third preferred embodiment of the present invention is adapted to a modern bow.
Figure 9:
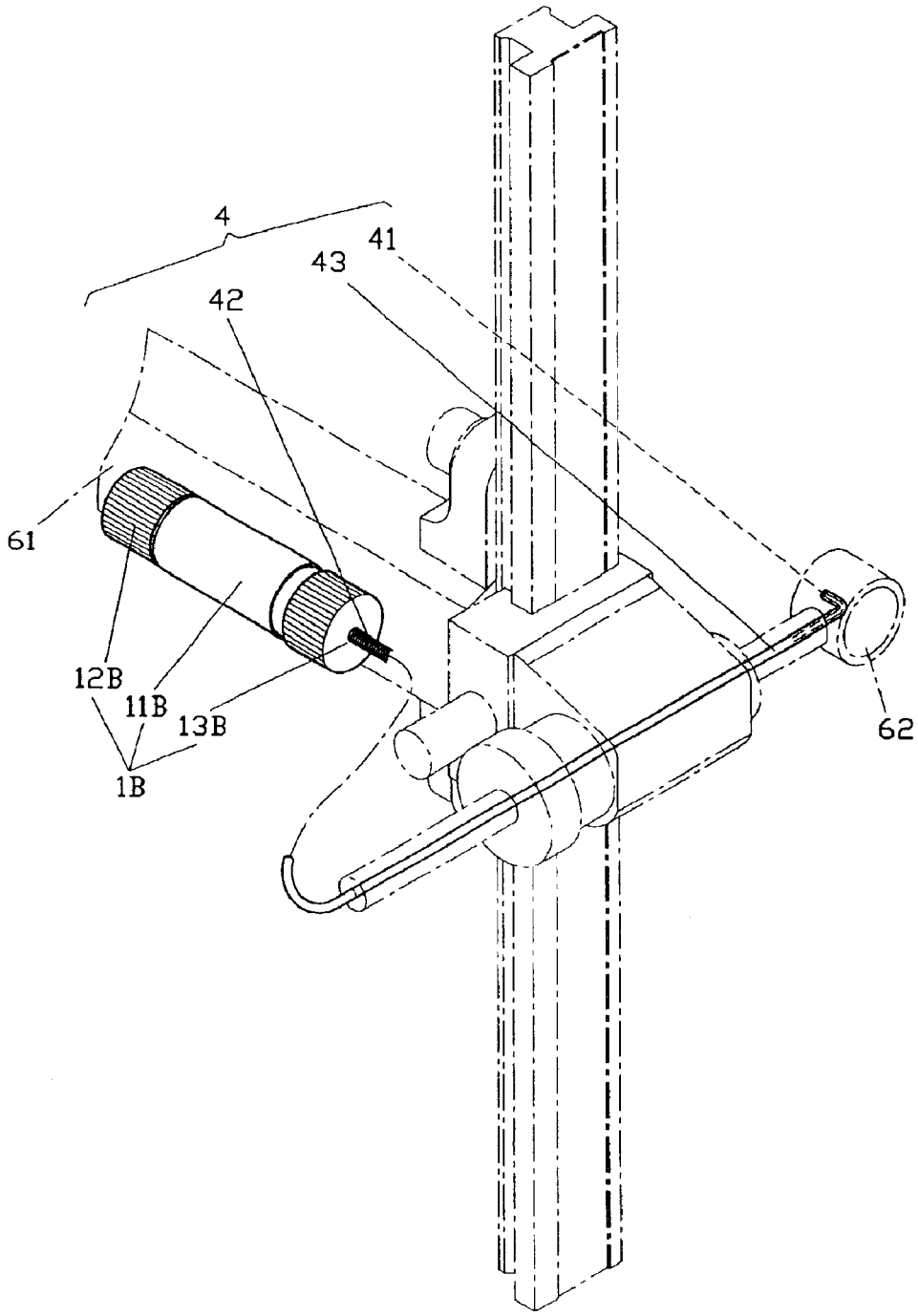
FIG. 9 is an enlarged view showing that the third preferred embodiment of the present invention is adapted to the modern bow.

FIGS. 8 and 9 are schematic views showing the third preferred embodiment of the present invention applied to a modern bow (6). Wherein, a comparatively special front sight (61) is provided on the modern bow (6). Therefore, the tube (11B) of the casing (1B) is directly fixed to the front sight (61) of the modern bow (6) while leaving both the first switch (12B) and the second switch (13B) exposed in order to facilitate operation. Though the light conductor (4) is fixed to the tube (11B), the flexible protection tube (42) and the rigid protection tube (43) are extended to the other end of the optical fiber (41) (not illustrated as it is contained in both of the flexible protection tube (42) and the rigid protection tube (413)) at the location of a front sight housing (62).

I claim:

1. A night vision device to mark the location of a front sight comprising:

a casing;

a power source; and a light emission device adapted to the front sight, wherein; the casing includes a tube and a switch set, the tube containing the power source, which is connected to the light emission device, the switch set controls power flow to the light emission device in order to mark, by the light emitted from the light emission device, the location of the front sight during night hours or when visual contact is conditions are poor;

wherein said switch set includes a first switch and a second switch, both ends of said tube being respectively provided with external threads, threads being further provided on said first switch and said second switch for respective engagement with said external threads of said tube, said tube further having a hole formed therethrough at a central portion thereof, said power source having a first electrode and a second electrode and said light emission device having a first electrode pin and a second electrode pin, whereby said light emission device is inserted into said tube through said hole with said first and second electrode pins being received within said tube, said power source being received within said tube of said casing and said first switch threadedly engaging one end of said tube, said second electrode of said power source contacting said first electrode pin of said light emission device and said first electrode of said power source contacting said first switch, said second switch threadedly engaging the other end of said tube;

whereby, said second switch being selectively tightened by a user in order to contact said second electrode pin of said light emission device and said first electrode of said power source being released from contact with said first switch when said first switch is selectively loosened, or said second switch being released from contact with said second electrode pin when said second switch is selectively loosened;

an elastic member being further provided with a sleeve member for fixed securement with said second switch, said elastic member and said sleeve contacting said second electrode pin of said light emission device when said second switch is selectively tightened.

2. The night vision device to mark the location of a front sight as claimed in claim 1, wherein, a light conductor is further provided on a front end of the light emission device to conduct the light emitted by the light emission device to the front sight.

3. The night vision device to mark the location of a front sight as claimed in claim 1, wherein a retainer is provided in the first switch, an insulating elastic washer is inserted on one end of the retainer, and the elastic insulating elastic washer being slightly compressed to contact the power source upon selective tightening of the first switch.

4. The night vision device to mark the location of a front sight as claimed in claim 2, wherein, the light conductor is an optical fiber.

5. The night vision device to mark the location of a front sight as claimed in claim 2, wherein, the light conductor is an optical fiber wrapped up with a protection tube.

6. A night vision device to mark the location of a front sight as claimed in claim 5, wherein, the protection tube wrapping up the optical fiber of the conductor is comprised of a flexible section connected to a rigid section.

* * * * *